United States Patent [19]

Franzen

[11] 4,297,834

[45] Nov. 3, 1981

[54] YARN BRAKE FOR A TEXTILE YARN PROCESSING MACHINE

[75] Inventor: Gustav Franzen, Willich, Fed. Rep. of Germany

[73] Assignee: Palitex Project Company GmbH, Krefeld, Fed. Rep. of Germany

[21] Appl. No.: 116,398

[22] Filed: Jan. 29, 1980

[30] Foreign Application Priority Data

Jan. 29, 1979 [DE] Fed. Rep. of Germany ..... 2903337

[51] Int. Cl.[3] ..... D01H 7/86; D01H 13/10; D01H 15/00

[52] U.S. Cl. ..... 57/58.86; 57/279; 242/147 M; 242/149

[58] Field of Search ..... 57/58.49, 58.83, 58.86, 57/279, 280; 242/147 R, 147 M, 149, 150 R, 150 M, 152.1

[56] References Cited

U.S. PATENT DOCUMENTS

| | | | |
|---|---|---|---|
| 2,620,617 | 12/1952 | Bley | 57/58.86 X |
| 2,667,029 | 1/1954 | Uhlig | 57/58.86 |
| 2,827,756 | 3/1958 | Kellogg et al. | 57/58.86 |
| 3,309,858 | 3/1967 | Franzen | 57/58.86 |
| 3,352,510 | 11/1967 | Franzen | 242/149 |
| 3,410,071 | 11/1968 | Heimes | 57/58.86 X |
| 3,975,893 | 8/1976 | Franzen | 57/279 |
| 4,168,605 | 9/1979 | D'Agnolo | 57/279 |

FOREIGN PATENT DOCUMENTS

| | | | |
|---|---|---|---|
| 1510833 | 10/1970 | Fed. Rep. of Germany | 57/58.86 |

*Primary Examiner*—John Petrakes

*Attorney, Agent, or Firm*—Bell, Seltzer, Park & Gibson

[57] ABSTRACT

The yarn brake of this invention is useful in a textile yarn processing machine, such as a two-for-one twister, and includes a stationary permanent magnet arranged at one end of a brake housing and spaced from a fixed braking surface in the direction of movement of the yarn. A braking body is movably positioned within the housing between the braking surface and the permanent magnet, with the braking body including a permanent magnet having a magnetic polarization oriented in repelling relation to the stationary permanent magnet for thus biasing the braking body toward and into engagement with the braking surface to apply tension to a yarn passing therebetween. The magnetic repelling forces allow the braking body to be reliably moved out of engagement with the braking surface when necessary, as for example by a pneumatic flow applied to thread a yarn through the brake, or to accommodate knots or other variations in thickness in the yarn.

6 Claims, 2 Drawing Figures

YARN BRAKE FOR A TEXTILE YARN PROCESSING MACHINE

FIELD OF THE INVENTION

This invention relates to a yarn brake which may be used on a textile yarn processing machine, such as a two-for-one twister, for applying a braking force or tension to a yarn, and more particuarly relates to an improved construction of a yarn brake of the type wherein a braking body is held in an applied position against a braking surface by permanent magnets.

BACKGROUND OF THE INVENTION AND PRIOR ART

In yarn brakes of this general type, it is necessary to separate the braking body and the braking surface during threading of the yarn therethrough or during the passage of an enlarged portion of the yarn, e.g. a knot, therebetween. Previously known constructions of yarn brakes of this general type have suffered from problems with respect to the separation of the braking body and the braking surface for these purposes.

One example of a known yarn brake of the general type noted above is described in German Patent Specification No. 15 10 833. In the yarn brake of this patent, a permanent magnet is arranged in a fixed position in the region of the fixed braking surface of the brake housing and this magnet draws a conical braking body consisting of ferromagnetic material against the braking surface of the brake housing by magnetic attraction. For a yarn to be threaded through the yarn passageway, and in particular for it to be so threaded pneumatically, it is necessary for the braking body to be lifted away from the fixed braking surface temporarily so that the yarn can be fed through between the braking surface and the braking body, which are then spaced apart from one another. This lifting or releasing of the movable braking body from the fixed braking surface may be achieved either mechanically or pneumatically, for example by means of a suction flow of air which also serves to thread the yarn through the yarn passageway while at the same time pulling the movable braking body away from the fixed braking surface overcoming the attracting force of the fixed permanent magnet.

However, when the movable braking body is held in its applied position against the fixed braking surface by forces of magnetic attraction, a tendency to "stick" may be observed which is particularly pronounced when the distance between the fixed permanent magnet and the movable ferromagnetic braking body is relatively small. This tendency to stick is a particular disadvantage or nuisance when the yarn is to be threaded through the yarn passageway pneumatically, and thus when the movable braking body is also to be lifted away from the fixed braking surface pneumatically. This undesirable sticking tendency also may occur during the operation of the braking mechanism since any bulge, e.g. a knot, in the yarn must open the brake to allow passage of the bulge therethrough.

Another yarn brake of this general type, as disclosed in U.S. Pat. No. 3,352,510, has attempted to use magnetic repelling force for applying the braking force to the yarn. While avoiding the aforementioned "sticking" problem, this yarn brake has presented additional problems, as will be described. The yarn brake disclosed in this U.S. Patent has a substantially tubular brake housing and a capsule shaped braking body which is situated between a fixed annular braking surface at the top and a movable annular braking surface at the bottom. The movable annular braking surface is mounted so as to be slidably movable in the axial direction, so that the upper and lower annular braking surfaces can be moved into engagement with opposite ends of the capsule shaped braking body. The movable annular braking surface at the bottom is connected to a permanent magnet, with which there is associated in spaced relation a second annular magnet which can be locked at various heights. The two magnets are so arranged that their like poles are situated opposite one another, and the repelling force of the magnets biases the movable annular braking surface upwardly into an operative position wherein the upper and lower braking surfaces are in engagement with the capsule shaped braking body. The sliding mounting for the lower braking surface accommodates for variations in thickness in the yarn running through the yarn brake and also allows for release of the brake during pneumatic threading of the yarn through the brake housing. However, due to the dust and lint which is produced when textile material is being handled, there is a danger of fouling which may interfere with movement of the lower braking surface, with the result that the braking body will no longer be capable of resiliently yielding in response to variations in thickness of the yarn passing through the brake or in response to the pneumatic threading of the filament through the brake housing.

SUMMARY OF THE INVENTION

With the foregoing in mind, it is an object of the present invention to provide an improved construction of a yarn brake of the type wherein a braking body is held in an applied position against a braking surface by a permanent magnet, and which is particularly constructed so as to provide certain and reliable release of the braking body from the braking surface when a specified force, for example a pneumatic force, is applied, and which also makes it easier for an enlarged portion of the yarn to pass therethrough.

This object is achieved in accordance with this invention by a yarn brake of a construction wherein a stationary permanent magnet is arranged at one end of the brake housing spaced from a fixed braking surface in the direction of movement of the yarn, and a braking body is movably positioned within the housing between the braking surface and the permanent magnet, with the braking body comprising a permanent magnet having a magnetic polarization oriented in repelling relation to the stationary permanent magnet for thus biasing the braking body toward and into engagement with the braking surface to apply tension to a yarn passing therebetween.

The force for braking the yarn is thus produced by two permanent magnets which repel one another. Mutually repelling magnets are gentler in operation than mutually attracting magnets. Because of the virtually floating mounting which this produces for the movable braking body, the tendency to stick which is observed with mutually attracting magnets is overcome to thereby ensure that the movable braking body will reliably lift away or release from the fixed braking surface upon the action of a mechanical or pneumatic displacing force. The yarn brake of this invention is also constructed so as to eliminate any opportunity for dust or lint to accumulate therein, which might foul the mechanism and interfere with free movement of the braking body, and the yarn brake of this invention thus avoids the problem noted above with respect to some of the prior yarn brake constructions.

The movable braking body utilized in the yarn brake of this invention is preferably in the general form of a capsule, preferably an elongated capsule, in which the permanent magnet is inserted. The stationary companion magnet is preferably in the form of an annular magnet which lies directly opposite the permanent magnet of the braking body, with the moving yarn passing through the opening in the annular stationary magnet.

The movable braking body is preferably provided with a guiding stem which projects through the opening of the annular magnet and into the passageway for the yarn in the direction of movement of the yarn. This prevents the movable braking body from tilting to an excessive degree when it is lifted away from the braking surface, and at the same time it helps with the correct return of the braking body under the influence of the magnetic repelling forces when the pneumatic or mechanical displacing force acting on the movable body is stopped.

The yarn brake of this invention may be advantageously utilized in the spindle of a textile yarn processing machine, such as a two-for-one twister, wherein the spindle has an axial yarn passageway extending therethrough and a threading mechanism is provided for creating a pneumatic flow in the yarn passageway to automatically thread a yarn through the yarn passageway during a thread-up operation. In such an arrangement, the improved construction of the yarn brake mechanism serves to facilitate automatic threading of the yarn through the yarn passageway by ensuring reliable movement of the braking body to a released position spaced from the braking surface when the threading mechanism is actuated and a pneumatic displacing force is exerted on the movable braking body. When the thread-up operation is completed and the threading mechanism is turned off, the braking body returns to its operative braking position in engagement with the braking surface.

BRIEF DESCRIPTION OF THE DRAWINGS

Some of the freatures and advantages of the invention having been stated, others will become apparent when the description proceeds when taken in connection with the accompanying drawings, in which—

DESCRIPTION OF ILLUSTRATED EMBODIMENT

Figure 1:
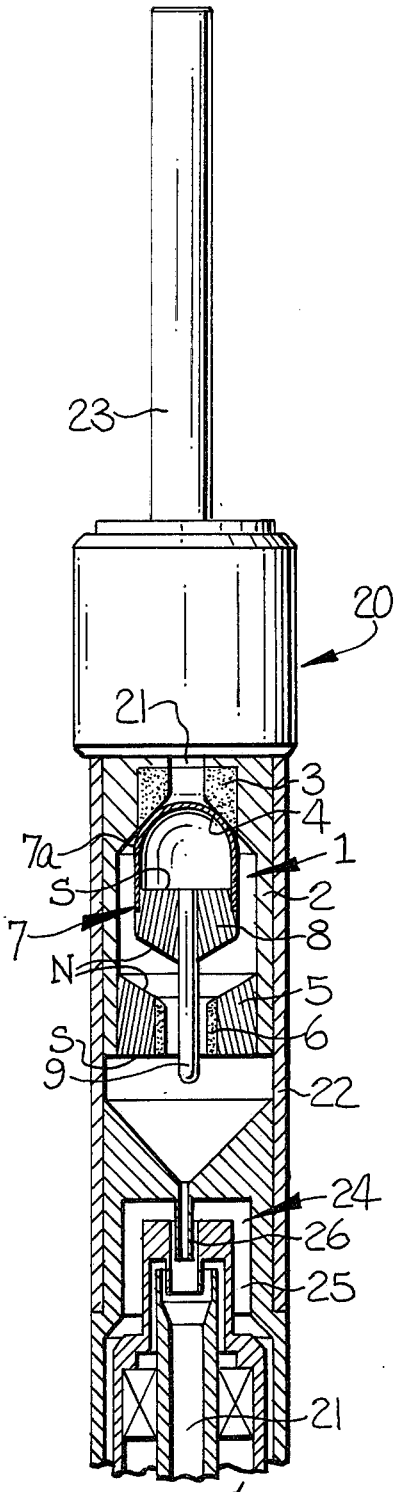
FIG. 1 is a side elevational view of a spindle of a textile yarn processing machine, with portions thereof shown in cross section to reveal the yarn brake of the invention, and with the yarn brake shown in the operative or engaged position.

Referring now more particularly to the drawings, the yarn brake of this invention is generally indicated in the drawings by the reference character 1. For purposes of illustration, the yarn brake 1 is shown as a part of a spindle 20 of a textile yarn processing machine, such as a two-for-one twister. The spindle 20, more particularly, has a composite passageway 21 extending longitudinally therethrough and along which a yarn Y may pass during operation of the textile machine. As illustrated, the spindle 20 includes a hollow tubular spindle housing 22 in which the yarn brake 1 is mounted, with a yarn entry tube 23 extending upwardly from the upper end of the spindle housing 22. During normal operation of the textile machine the yarn Y passes downwardly through the yarn passageway 21 and the yarn brake 1 serves to apply desired tension to the yarn.

In order to initially thread the yarn through the elongate passageway 21, the spindle is provided with a pneumatic threading mechanism 24, located below the yarn brake 1, which, when actuated, creates a pneumatic flow along the yarn passageway 21 for threading the yarn therealong. The yarn threading mechanism 24 includes an air passageway 25 for directing compressed air from a compressed air source (not shown) to an air injector nozzle 26 surrounding a portion of the yarn passageway 21. When compressed air is supplied along the compressed air passageway 25, a positive flow of compressed air is created in the portion of the passageway 21 below the nozzle 26 and a suction air flow is created in the passageway 21 above the nozzle 26 which causes the yarn to be sucked into the inlet end of the yarn entry tube 23 and along the passageway 21. The pneumatic yarn threading mechanism 24 is of a known construction, and described for example in commonly owned U.S. Pat. No. 3,975,893. Reference may be made to this commonly owned patent for a more complete description of the construction and operation of the yarn threading mechanism 24 and for further details of the construction of the spindle 20.

Referring now more particularly to the construction of the yarn brake 1, the yarn brake includes a substantially tubular brake housing 2, which is mounted within the spindle housing 22 and having the yarn passageway 21 extending axially therethrough. An annular braking ring 3, formed of an abrasion resistant material, is mounted at the upper end of the brake housing 2 with the central opening of the annular ring 3 positioned coaxially with the yarn passageway 21. The braking ring 3 has an annular conical braking surface 4 which surrounds the entrance of the yarn passageway 21 through the brake housing. Mounted at the lower end of the brake housing 2 is a stationary annular permanent magnet 5, in which is inserted an abrasion resistant annular body 6.

Located within the brake housing 2 between the braking surface 4 and the stationary annular magnet 5 is a movable braking body, generally indicated at 7. The braking body 7 is substantially in the form of an elongated capsule and includes a dome-shaped element **7*a* in which an annular permanent magnet 8 is mounted in the lower end thereof. The upper end of the dome-shaped element 7*a* serves to define a movable braking surface for cooperating with the stationary annular conical braking surface 4. The two permanent magnets 5 and 8 are arranged with like magnetic poles situated opposite one another so that the two magnets are oriented in repelling relation to one another. As a result of the repelling forces of the magnets, the braking body 7 is biased upwardly toward and into engagement with the fixed braking surface 4. Thus, a yarn which is directed downwardly along the passageway 21 passes between the fixed braking surface 4 and the movable braking body 7, and tension is applied to the downwardly moving yarn as dictated by the repelling force of the permanent magnets 5 and 8. To permit adjustment of the tension or braking force applied to the yarn, the annular permanent magnet 5** can be adjusted in the axial direction and can be locked in position at different heights by suitable mechanisms not shown herein.

At the end of the braking body 7 remote from the braking surface 4 a guide stem 9 is mounted so as to project axially in the direction of movement of the yarn and into the central opening of the annular permanent magnet 5, or more particularly the inserted body 6. This guide stem 9 helps to prevent the braking body 7 from tilting to an excessive degree inside the brake housing 2 when the braking body is spaced away or released from the braking surface 4.

Figure 2:
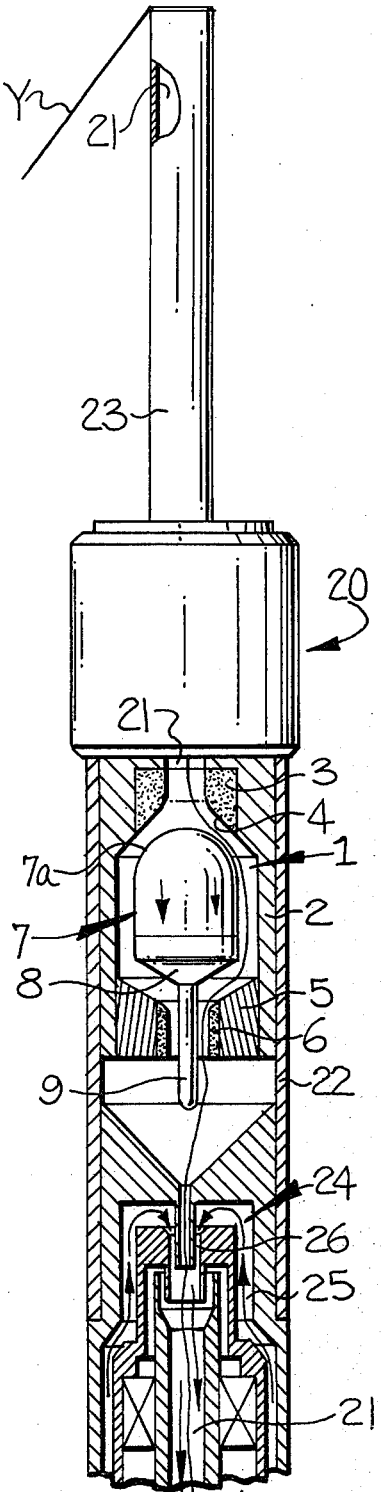
FIG. 2 is a view similar to FIG. 1, but wherein the yarn brake is shown in the released position during a yarn thread-up operation.

During normal operation of the textile yarn processing machine, the braking body 7 is maintained in the engaged or operative position illustrated in FIG. 1 by the repelling forces of the magnets 5 and 8. However, under the influence of a mechanical or pneumatic displacing force of a magnitude sufficient to overcome the repelling force of the magnets 5, 8, the braking body 7 may be readily moved out of engagement with the braking surface 4 and to a released or spaced position such as that shown in FIG. 2. For example, when the pneumatic yarn threading mechanism 24 is actuated, the suction created by the injector nozzle 26 overcomes the magnetic repelling force of the magnets 5 and 8 and pulls the braking body downwardly and out of engagement with the braking surface 4 to provide a clear path for the yarn to be pneumatically threaded along the passageway 21. When the thread-up operation is completed and the pneumatic flow along the passageway 21 is stopped, the braking body 7 automatically returns to the braking position shown in FIG. 1. The guide stem 9 helps the braking body 7 to return correctly to the proper braking position when the externally applied displacing force is stopped.

It will thus be seen that the construction of the yarn brake in accordance with this invention provides for reliable and certain release of the braking body from the braking surface when a specified displacing force, such as a pneumatic or mechanical force, is applied, and ensures reliable return of the braking body to the braking position when the displacing force is stopped. In this regard, it will be appreciated that the brake is so constructed as to avoid the opportunity for lint or dust to collect therein which might interfere with the free movement of the braking body and the desired releasing or spacing thereof from the braking surface.

In the drawings and specification, there has been set forth a preferred embodiment of the invention, and although specific terms are employed, they are used in a generic and descriptive sense only and not for purposes of limitation.

What is claimed is:

1. A yarn brake for applying tension to a yarn and comprising a substantially tubular brake housing having a passageway therethrough adapted for receiving a yarn moving in a predetermined direction, a stationary braking surface provided in said housing, a stationary permanent magnet positioned in said housing and longitudinally spaced from said braking surface in the direction of movement of the yarn, and a braking body positioned for longitudinal movement within said housing between said braking surface and said stationary magnet, said braking body comprising a permanent magnet having a magnetic polarization oriented in repelling relation to said stationary magnet for biasing the braking body toward and into engagement with said braking surface to apply tension to a yarn passing therebetween while allowing reliable separation of said braking body and said braking surface under the influence of a displacing force greater than the repelling force of said magnets.

2. A yarn brake according to claim 1 wherein said braking surface is of a substantially annular conical configuration and surrounds the entrance of the yarn passageway through said brake housing, and wherein said braking body is substantially in the form of an elongate capsule having a rounded end portion adapted for engaging the conical annular braking surface.

3. A yarn brake according to claim 1 wherein the permanent magnet of said braking body is arranged at the end of the braking body remote from said braking surface.

4. A yarn brake according to any one of claims 1 to 3 wherein said stationary permanent magnet is of a substantially annular configuration having a central opening positioned coaxially with the yarn passageway through said housing.

5. A yarn brake according to claim 4 including a guide stem carried by the end of said braking body remote from said braking surface, and said guide stem projecting axially into the opening of said annular stationary magnet.

6. In a spindle of a textile yarn processing machine having an axial yarn passageway extending therethrough and including a threading mechanism for creating a pneumatic flow in said yarn passageway to automatically thread a yarn therethrough during a thread-up operation, the combination therewith of an improved yarn brake for applying tension to the yarn passing through the yarn passageway during normal operation and constructed so as to readily accommodate the passage of enlarged portions in the yarn and to facilitate automatic threading of the yarn through said yarn passageway during a thread-up operation, said yarn brake comprising a substantially tubular brake housing mounted in said spindle and adapted for receiving a yarn therethrough in a predetermined direction, a stationary braking surface provided in said housing, a stationary permanent magnet positioned in said housing and longitudinally spaced from said braking surface in the direction of movement of the yarn, and a braking body positioned for longitudinal movement within said housing between said braking surface and said stationary magnet, said braking body comprising a permanent magnet having a magnetic polarization oriented in repelling relation to said stationary magnet for biasing the braking body toward and into engagement with the braking surface during normal operation to apply tension to a yarn passing therebetween, and wherein the two magnets have a repelling force which is smaller than the pneumatic force exerted on the braking body by said threading mechanism so that the brake is automatically released when a yarn is pneumatically threaded through the passageway and automatically returns to the braking position when the thread-up operation is completed.

* * * * *